US006419216B1

(12) United States Patent
Susnjara

(10) Patent No.: US 6,419,216 B1
(45) Date of Patent: Jul. 16, 2002

(54) WORKPIECE HOLDDOWN SYSTEM FOR MACHINE TOOLS

(75) Inventor: Kenneth J. Susnjara, Birdseye, IN (US)

(73) Assignee: Thermwood Corporation, Dale, IN (US)

( * ) Notice: Subject to any disclaimer, the term of this patent is extended or adjusted under 35 U.S.C. 154(b) by 0 days.

(21) Appl. No.: 09/611,884

(22) Filed: Jul. 7, 2000

(51) Int. Cl.[7] ..... B25B 11/00
(52) U.S. Cl. ..... 269/21; 269/296
(58) Field of Search ..... 269/21, 20, 296; 451/388; 294/64.1; 279/3

(56) References Cited

U.S. PATENT DOCUMENTS 5,553,837 A * 9/1996 Kahle ..... 269/21
5,704,599 A * 1/1998 Slothower ..... 269/21
5,853,169 A * 12/1998 Hern et al. ..... 269/21
5,961,169 A * 10/1999 Kalenian et al. ..... 269/21
6,032,997 A * 3/2000 Elliott et al. ..... 269/21
6,182,955 B1 * 2/2001 Kimble ..... 269/21

* cited by examiner

*Primary Examiner*—Joseph J. Hail, III
*Assistant Examiner*—Lee Wilson
(74) *Attorney, Agent, or Firm*—Stevens, Davis, Miller & Mosher

(57) ABSTRACT

A working hold-down system for a worktable of a machine tool having a wall member for supporting the workpiece, defining a plenum connectable to a vacuum source; a surface portion cooperable with the workpiece and a seal, defining a zone; a passageway intercommunicating the plenum with the zone; and a valve disposed in the passageway. In operation, the vacuum source generates a vacuum in the plenum connected to the zone by the passageway to hold down the workpiece on the worktable. The system further includes a fixture connectable to the wall member via the vacuum source having a surface that is cooperable with workpiece and the seal defining the zone. For large, flat workpieces, a porous spoilboard replaces the supporting wall member to create a universal hold-down system.

22 Claims, 6 Drawing Sheets

WORKPIECE HOLDDOWN SYSTEM FOR MACHINE TOOLS

This invention relates to machine tools and more particularly to an improved system for holding down workpieces on the worktables of such machines.

BACKGROUND OF THE INVENTION

In the woodworking, plastics, aerospace and other industries, CNC machines and particularly routers commonly have been used to machine workpieces of various materials including wood, plastic and nonferrous metals. Typically, such machines are provided with a worktable on which one or more workpieces are mounted to be machined or otherwise processed. In the past, such workpieces have been secured to the worktable mechanically by various means including bolts, clamps and the like. More recently, there have been developed systems utilizing vacuums for holding such workpieces in position, which have greatly improved productivity. Such systems have consisted of what have been termed conventional and universal systems. Conventional systems typically utilize a fixture equipped with a soft rubber seal that extends around the edge of the workpiece. Vacuum is applied to the zone within the seal which functions to hold the part to the fixture. Such type of system is commonly used to hold small workpieces. Universal vacuum systems typically have included a plenum provided in the worktable, connected to a vacuum pump and closed at its upper end by a porous spoilboard. In such systems, air drawn through the spoilboard by the vacuum applied to the plenum causes workpieces mounted on the spoilboard to be held fast to the spoilboard without the need of special fixtures or vacuum seals. Such continuous vacuum systems commonly have been used to hold relatively flat workpieces on worktables.

When used in their intended manner, the systems as described have been found to be highly effective in improving productivity. It has been found to be desirable, however, to provide a single holddown system which may be readily convertible to function either as a conventional or universal type of vacuum system.

SUMMARY OF THE INVENTION

The present invention provides a workpiece holddown system for the worktable of a machine tool generally consisting of means including a wall member for supporting one or more workpieces, defining a plenum connectable to a vacuum pump; means cooperable with a surface of a workpiece supported on the wall member, and an endless seal, defining a zone; means defining a passageway intercommunicating the plenum and the zone; and a valve disposed in such passageway. Such supporting wall member is particularly adapted to holddown comparatively small parts. When it is desired to process comparatively large, flat workpieces, such system may be converted into a universal type system merely by removing the supporting wall member and replacing it with a porous spoilboard.

DESCRIPTION OF THE PREFERRED EMBODIMENTS OF THE INVENTION

Figure 1:
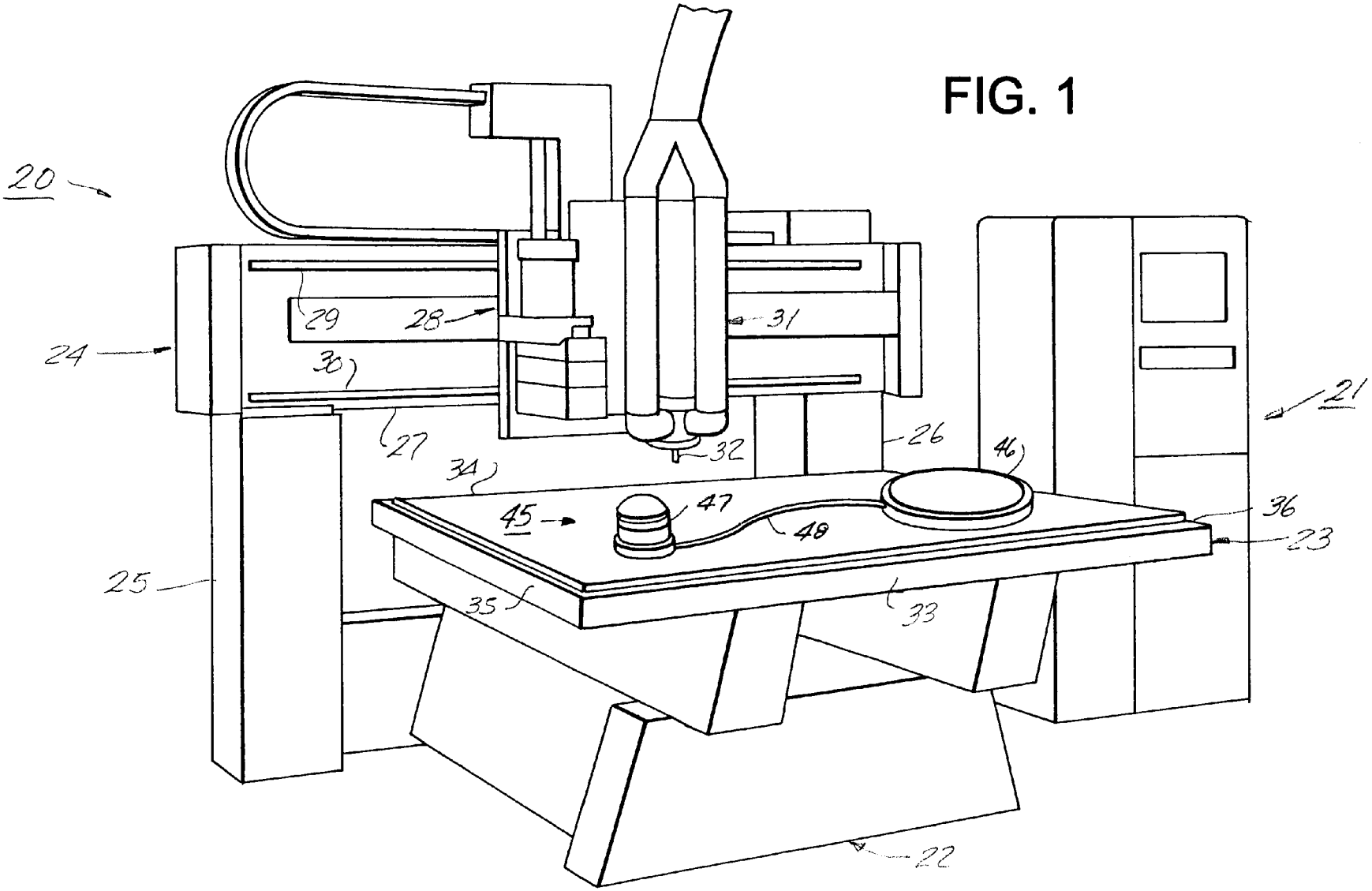
FIG. 1 is a perspective view of a CNC machine provided with a worktable embodying the present invention.

Referring to FIG. 1 of the drawings, there is illustrated a CNC machine 20 having a worktable incorporating an embodiment of the invention, and a controller 21 operatively connected to the machine for operating the machine in accordance with a selected program inputted into the controller. The machine includes a base number 22 a table 23 mounted on the base member and displaceable along a longitudinal or y-axis along a set of rails mounted on the base member, a gantry 24 including a pair of leg sections 25 and 26 rigidly secured at their lower ends to the base member and a transverse section 27 supported on and rigidly connected to the upper ends of the leg sections, a toolhead support assembly 28 supported on transverse section 27 and displaceable transversely or along a x-axis on a pair vertically spaced rails 29 and 30 mounted on a front face of transverse section 27 of the gantry and a toolhead assembly 31 mounted on the toolhead support assembly and displaceable vertically or along a z-axis. The machine is provided with various feed screws driven by servmotors operated by the controller to displace the table along the y-axis, the toolhead support assembly along the x-axis and the toolhead assembly along the z-axis. The toolhead assembly is provided with a spindle provided with a collet mechanism at the lower end thereof to which a cutting tool 32 may be removably attached.

Worktable 23 has a large, substantially rectangular configuration. It includes a support frame structure provided with a front frame member 33, a rear frame member 34 and a pair of side frame members 35 and 36, each having an inwardly projecting portion spaced from an upper edge thereof and extending the length thereof, cooperating to provide an inwardly projecting support ledge 37 extending about the inner periphery of the support frame structure. Disposed within and secured to the inner sides of the frame structure is a base member 38 open at an upper end thereof and having a lower inlet 39 connectable through a flexible conduit to a vacuum pump. A rectangularly configured wall member or spoilboard 40 is seated about the lower periphery thereof on support ledge 37, closing the upper end of base member 38 to form a plenum 41 communicating with the vacuum pump. The wall member freely sits on peripheral support ledge 37 and is provided with a peripheral seal 42 which prevents leakage of air between the periphery of wall member 40 and seating ledge 37. Wall member 40 further is provided with a plurality of openings 43, each intercommunicating the plenum and the exterior of the worktable, and a plurality of spaced locating recesses 44.

Mountable on wall member 40 is a workpiece holddown assembly 45 consisting of a fixture 46, a valve 47 and an interconnecting, flexible conduit 48. Fixture 46 is adapted to be positioned anywhere on wall member 40, overlying an opening 43, and is provided with an annular sealing element 43 between the fixture and wall member 40. The lower surface of the fixture, a portion of the upper surface of wall member 40 and seal 49 define a zone communicating with plenum 41 through an opening 43. A sealing element 50 is provided on the upper side of fixture 46 on which there is adapted to be supported a workpiece 51. The upper surface of the fixture, the lower surface of workpiece 51 and sealing element 50 define a closed zone communicating with an opening 52 through fixture 46 having at least one port 53 and a possible second port 54.

Figure 3:
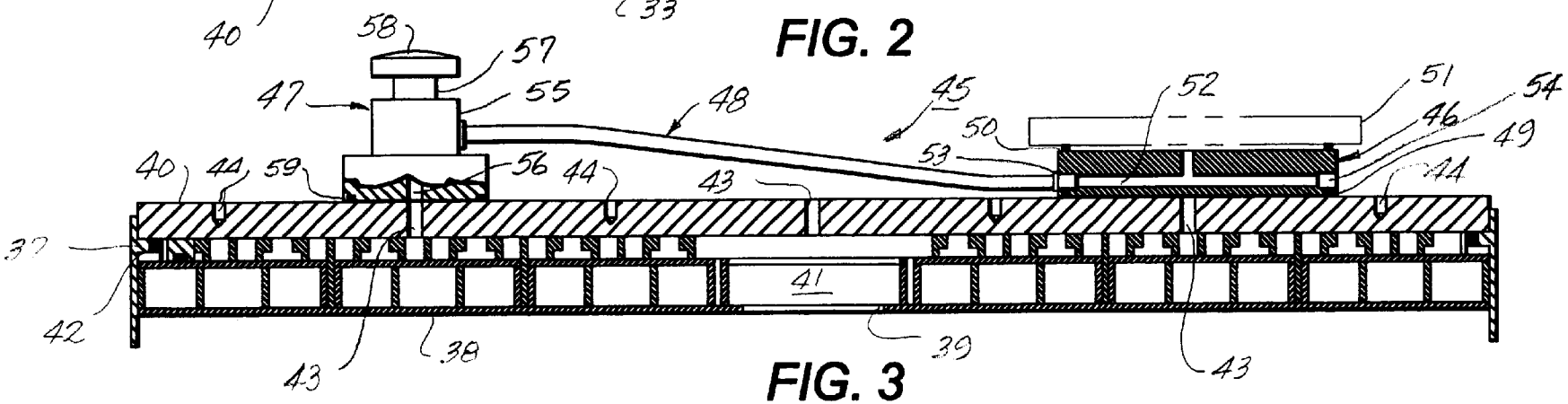
FIG. 3 is a cross sectional view taken along line 3—3 in FIG. 2.

Valve 47 is adapted to be positioned on wall member 40, and includes a body section 55 having an opening 56 therethrough, and a valve stem 57 displaceable to open and close opening 56, having a gripping head portion 58. Valve 57 is adapted to be positioned on wall member 40 with a lower port of opening 56 registered with an opening 43 in the wall member, as shown in FIG. 3. Leakage of air between valve 47 and wall member 40 is prevented by an annular sealing element 59 disposed therebetween. Conduit 48 interconnects the other port of opening 56 of valve body 47 and port 53 of opening 52 in fixture 46.

Figure 2:
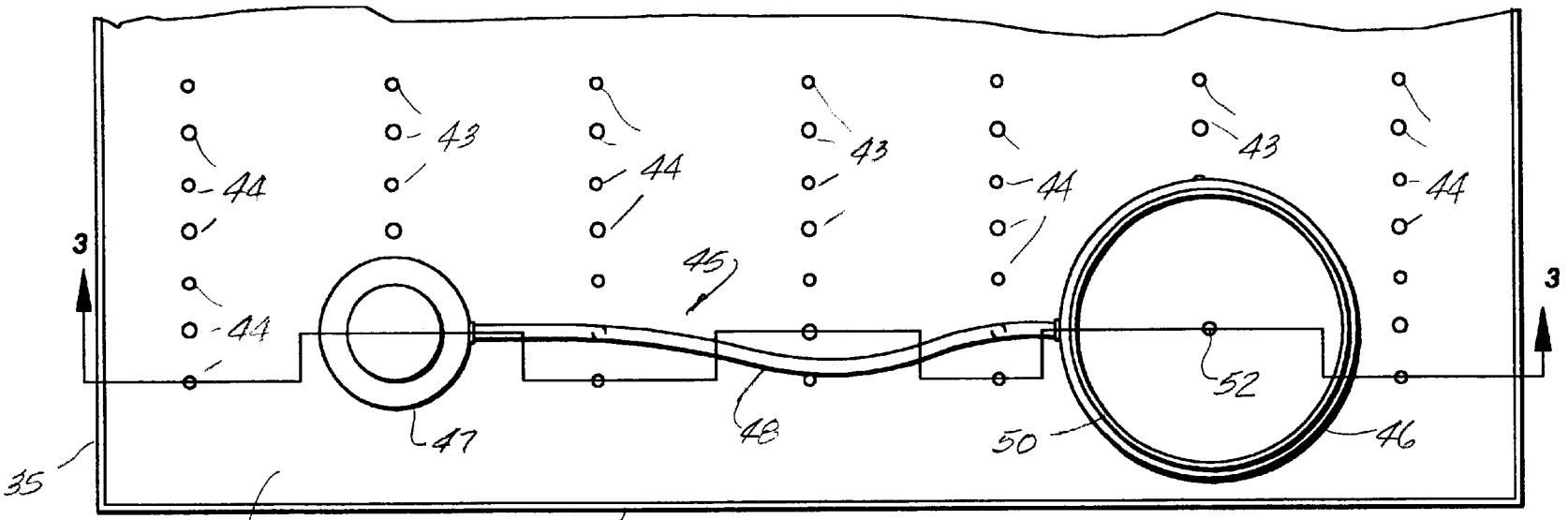
FIG. 2 is a top plan view of the embodiment shown in FIG. 1, having a portion thereof broken away.

In the use of the system shown in FIGS. 2 and 3, fixture 46 is positioned on wall member 40 at a desired location, overlying an opening 43, and valve 47 similarly is positioned on wall 40 overlying an opening 43 with the opening 56 of the valve body communicating with such opening 43. Port 54 and any other open ports of fixture 56 are plugged, and unused openings 43 in wall member 40 also are plugged. Workpiece 51 is positioned on fixture 56 and the vacuum pump connected to plenum 41 is operated. Under such conditions, a vacuum will be applied to plenum 41 and also to the zone between fixture 46 and wall member 40 to draw fixture 46 firmly against wall member 40, and the zone between valve 47 and wall member 40 to draw valve 42 firmly against wall member 40. Valve 47 may then be opened to apply a vacuum to the zone between workpiece 51 and fixture 56 to firmly hold such workpiece firmly on fixture 46. With the workpiece thus firmly held, machine 20 may be operated to machine or otherwise process workpiece 51.

A number of assemblies 45 similarly may be placed on wall member 40 to support and firmly hold a number of workpieces 51 to be machined or otherwise processed. In addition, a number of fixtures 46 may be positioned on wall member 40 with a number of conduits 48 connected to ports 54 to apply vacuum to the openings in each of such fixtures for holding workpiece thereon.

The embodiment shown in FIGS. 4 and 5 includes a support frame structure 60 similar to the frame structure described in connection with the embodiment shown in FIGS. 1 through 3, a base number 61 similar to member 38, secured within frame structure 60, a wall member 62 comparable to wall member 40, seated on an inwardly projecting, peripherally disposed ledge 63 of the frame structure and a valve 64 comparable to valve 47 having a conduit 65 connected thereto. Wall member 62 closes the upper end of base member 61 which is provided with a partition wall 66 providing a selected plenum section 67 isolated from main plenum section 68. Plenum section 68 is adapted to be connected to a vacuum pump and further communicates with the exterior through an opening 69 in wall member 62. Plenum section 67 is isolated from the vacuum pump and communicates with the exterior through an access opening 70 and a similar set of openings 71. Valve 64 further is provided with a depending conduit section 72 defining a port, which is adapted to be received in opening 69 upon positioning the valve on wall member 62. Conduit 65 is similar in function to conduit 48 and includes a free end 73 adapted to be inserted in opening 73 communicating with plenum section 67.

Figure 4:
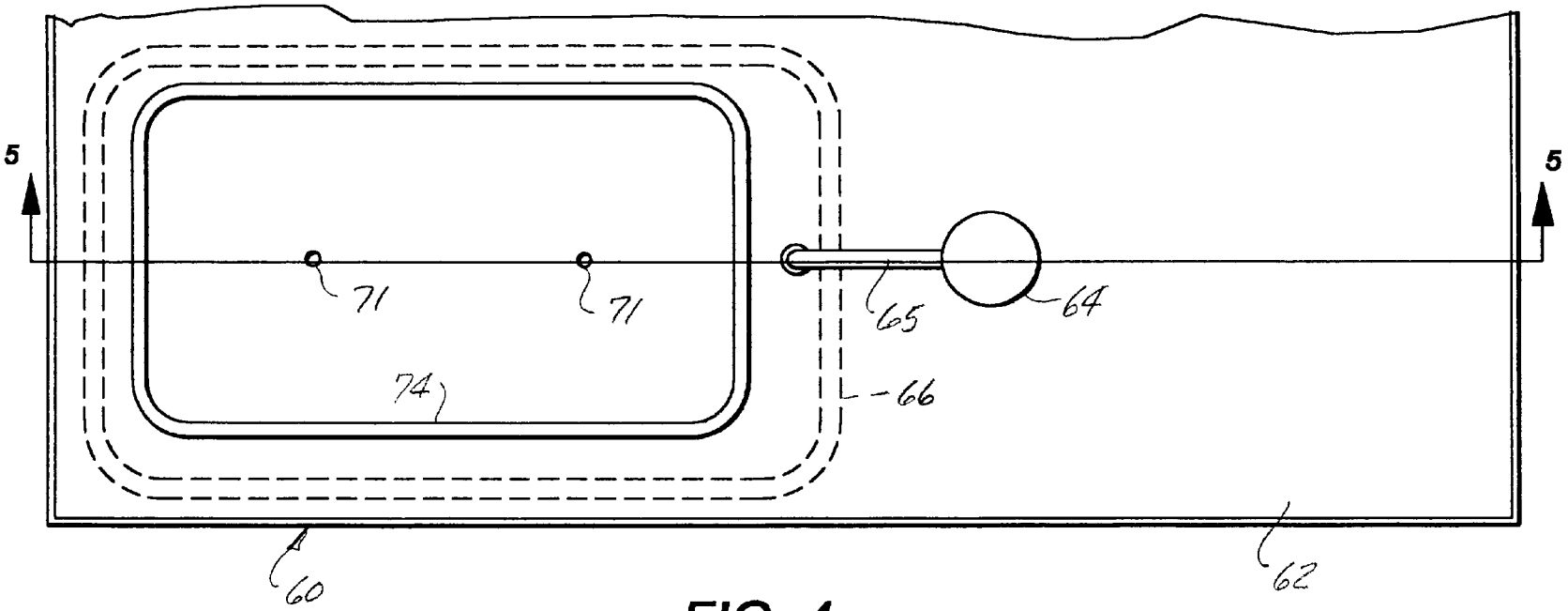
FIG. 4 is a top plan view similar to the view shown in FIG. 3, illustrating another embodiment of the invention.
Figure 5:
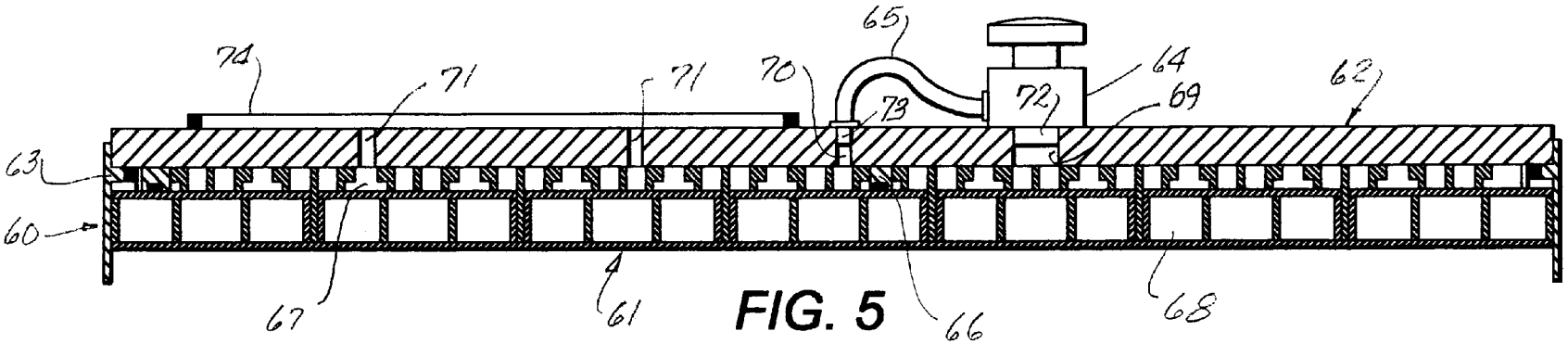
FIG. 5 is a cross sectional view taken along line 5—5 in FIG. 4.

In the use in the embodiment shown in FIGS. 4 and 5, with valve 64 mounted in outlet 69 and conduit 65 connected to outlet 70, a sealing element 74 is positioned on wall member 62, encompassing the outlets of passageways 71, and a workpiece is positioned on sealing element 74. The vacuum pump is then operated to apply a vacuum to plenum section 68. To then secure the workpiece to the wall member, valve 64 is opened to intercommunicate plenum sections 67 and 68 and thereby apply a vacuum in the zone defined by the bottom surface of the workpiece resting on the sealing element, the sealing element and the upper surface of wall member 62.

Additional workpieces may be nested and held tightly on wall member 62 simply by providing additional partition walls 66 on base member 61 providing a plurality of plenum sections isolated from a plenum section comparable to plenum 68 communicating with the vacuum pump, a plurality of sealing elements 74 each positioned on the wall member and encompassing one or more passageways communicating with an isolated plenum and providing a valve and connector for selectively applying a vacuum to the isolated plenum sections.

Figure 6:
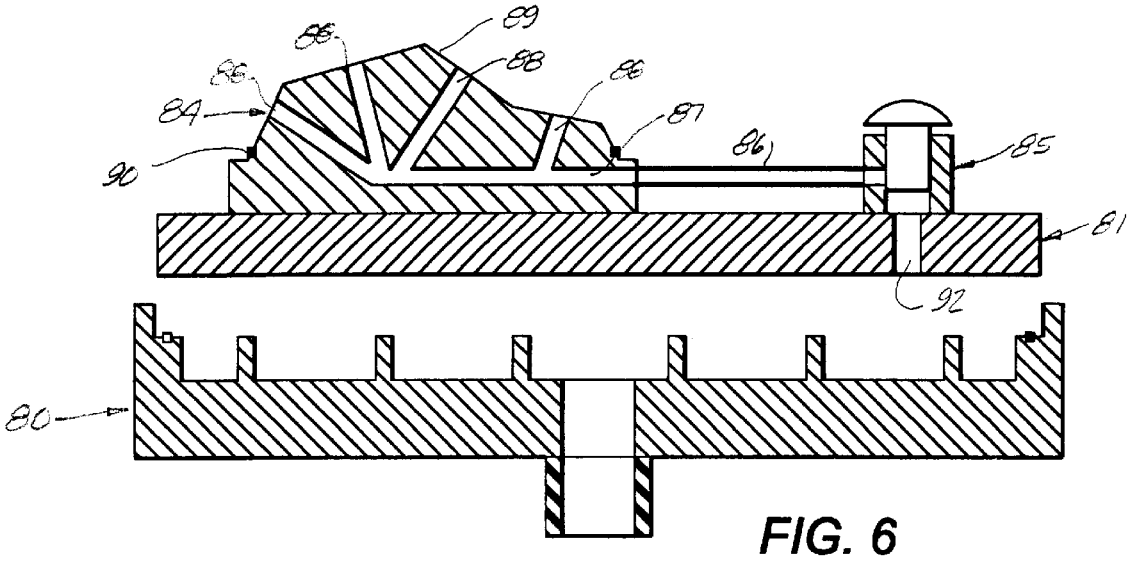
FIGS. 6 through 8 are vertical cross sectional views of a further embodiment of the present invention, illustrating the manner and use of the embodiment.
Figure 7:
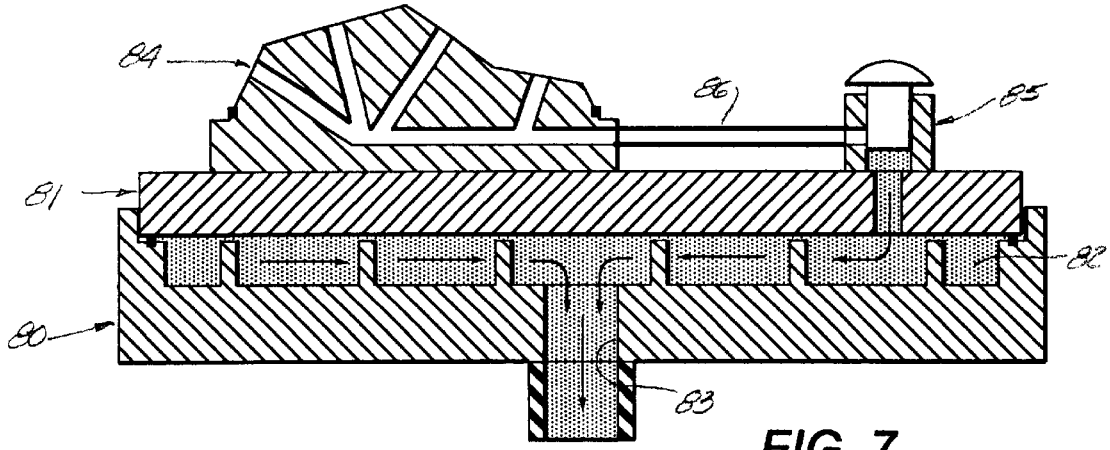
Figure 8:
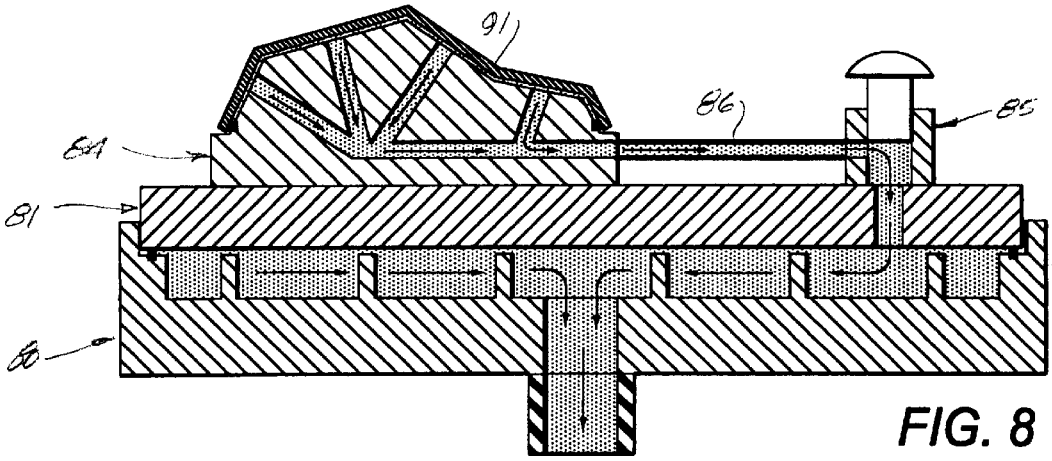

The embodiment shown in FIGS. 6 through 8 includes a base member 80 comparable to base member 38, having a recessed upper portion, a wall member 81 comparable to wall member 40, adapted to be seated in the upper end of the recess provided in the housing 80 to provide a plenum 82 communicating through an outlet 83 provided in member 80 to a vacuum pump, a three dimensional fixture 84 mounted on wall member 81 and a valve 85 comparable to valve 47 mounted on wall member 81 and having a conduit 86 connected to fixture 84. Fixture 84 is provided with a passageway 87 having a plurality of branch sections 88 with outlet ports at an outer surface 89. Mounted on outer fixture surface 89, encompassing the outlet ports of passageway sections 88, is a sealing element 90. As best shown in FIG. 8, a workpiece 91 having a configuration similar to the configuration of workpiece surface 89 is adapted to be mounted on fixture 84 in engagement with sealing element 90 to provide a zone defined by fixture surface 89, sealing element 90 and an undersurface workpiece 91, communicating with branch passageways 88. Valve 85 is mountable on wall member 81 so that a port thereof communicates with plenum 82 through an opening 92 provided in wall member 81. Conduit 86 interconnects valve 85 and fixture 84 and communicates with opening 87 therein.

In the use of the embodiment shown in FIGS. 6 through 8, when fixture 84 and valve 85 are mounted on wall member 81, as shown in FIG. 6, and wall member 81 is positioned on base member 80 to provide plenum 82, as shown in FIG. 7, the vacuum pump is operated to apply a vacuum to plenum 82. Workpiece 91 is then mounted on fixture 84 and valve 85 is opened to apply a vacuum to the zone provided between fixture 84 and workpiece 91, as shown in FIG. 8. When the machining or other processing of workpiece 91 has been completed, valve 85 may be closed to discontinue the application of a vacuum between the fixture and the workpiece thus freeing the workpiece and allowing it to be removed from the fixture.

A number of fixtures 84 may be mounted on wall member 81 along with a number of valves 85 connected in the manner described to such fixtures to provide for the mounting of a number of parts on the table of the machine for machining or other processing.

Figure 9:
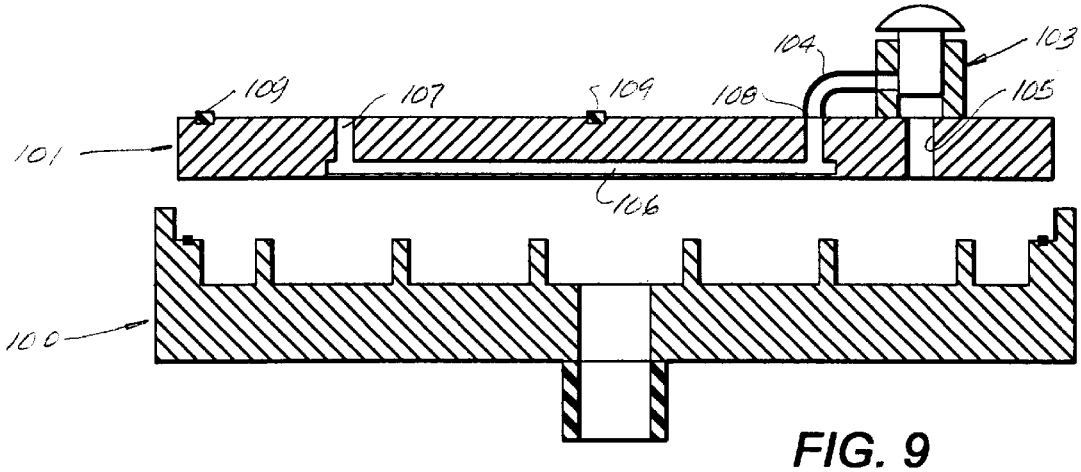
FIGS. 9 through 11 are vertical cross sectional views of a still further embodiment of the present invention, illustrating the manner of use of the embodiment.
Figure 10:
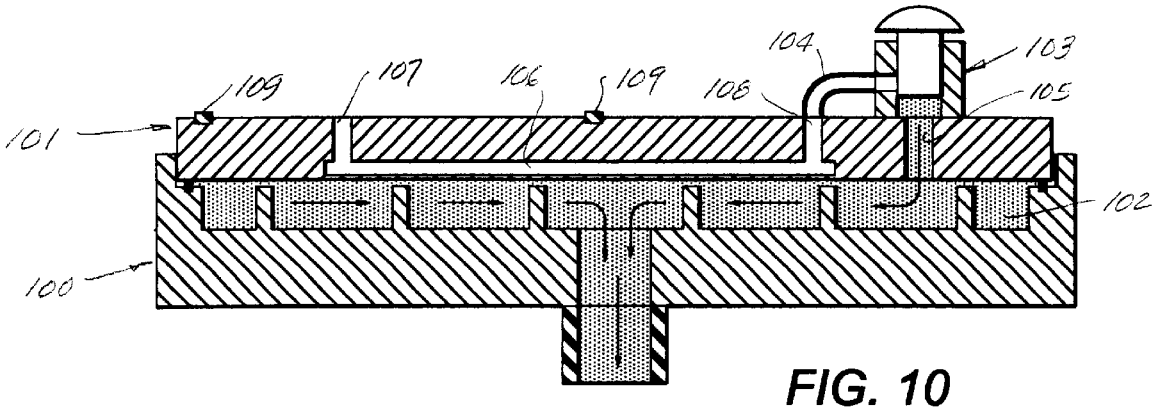
Figure 11:
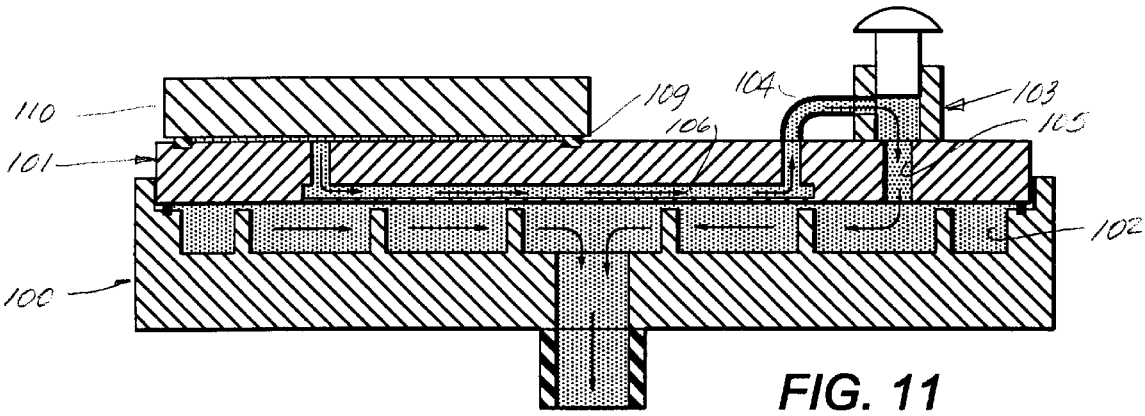

The embodiment shown in FIGS. 9 through 11 includes a base member 100 comparable to member 38, provided with an upwardly opening recess, a wall member 101 comparable to wall member 40, received within the recess of housing 100 and seated therein to provide a plenum 102 communicable through an opening in member 100 with a vacuum pump, and a valve 103 comparable to valve 47 having a conduit 104. Wall member 101 is provided with a first opening 105 therethrough and a second opening 106 therein having a set of ports 107 and 108 communicating with the upper side of the wall member. Mounted on an outer side of wall member 101 is a sealing element 109 encompassing opening port 107, which is adapted to support a workpiece 110. The upper surface of wall member 101, the underside of workpiece 110 and sealing element 109 interposed therebetween provide a zone between the wall member and the workpiece communicating with passageway 106 through port 107. Valve 103 is mountable on wall member 101 so that a port of the opening therethrough communicates with opening 105, and a free end of conduit 104 may be inserted in port 108 of passageway 106.

With valve 103 mounted on wall member 101 and the wall member mounted on housing 100 to form plenum 102, the vacuum pump connected to plenum 102 may be operated to apply a vacuum to the plenum, as shown in FIG. 10. Workpiece 110 may then be mounted on the wall member, seated on the sealing element 109 and overlying port 107 of passageway 106. Valve 103 may then be opened to apply a vacuum to the zone between the workpiece and the wall member to firmly hold the workpiece on the wall member. As described in connection with the other embodiments, it is contemplated that passageway 106 may be provided with a number ports comparable to port 107 and a number of sealing elements 109 may be provided encompassing such ports to provide for the mounting of a plurality of workpieces 110 on wall member 101.

Figure 12:
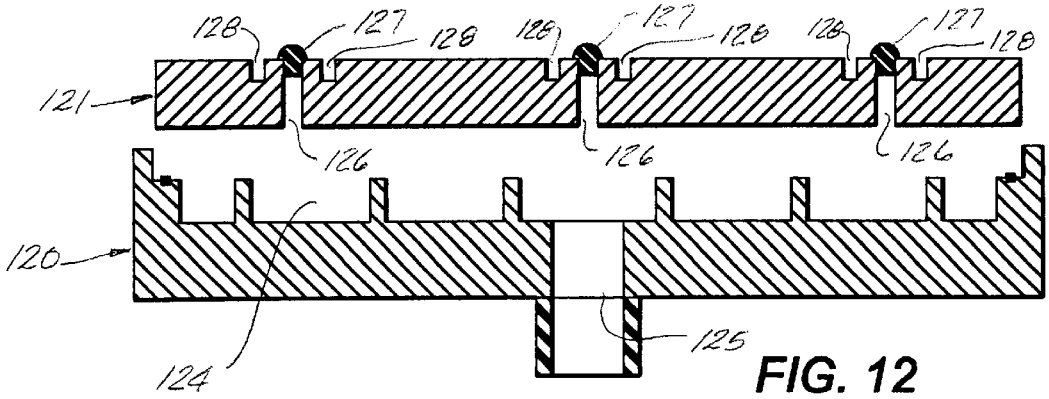
FIGS. 12 through 14 are cross sectional views of another embodiment of the invention, illustrating the manner of use of the embodiment.
Figure 13:
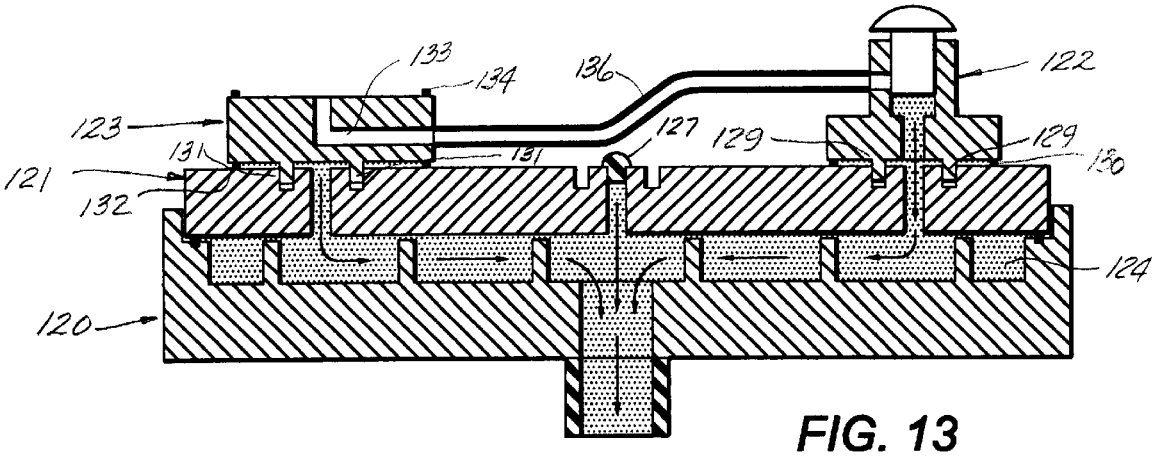
Figure 14:
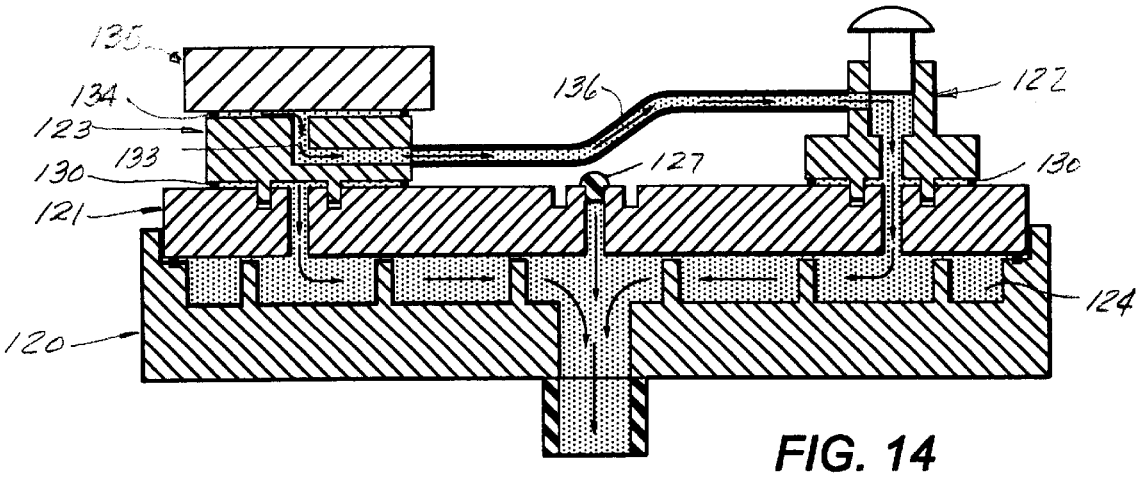

FIGS. 12 through 14 illustrate a still further embodiment of the present invention which generally includes a base member 120, a support wall member 121, at least one valve 122 and at least one workpiece support fixture 123. The base member is recessed at the upper end thereof in which there is adapted to be received and seated support wall member 121 to form a plenum 124 as in the previously described embodiments. Base member 120 is provided with a port 125 which may be connected to a vacuum pump. Support wall member 121 is provided with a plurality of spaced passageways 126 intercommunicating the plenum and the exterior of the wall member. Each of such passageways normally is closed with a removable plug 127, and a set of positioning recesses 128 adapted to receive depending pin portions of valve 22 and workpiece support fixtures 123 for positioning such valves and workpieces on the support wall member. Valve 122 is similar to the valves described in connection with the previously described embodiments, and further includes a set depending pins 129 adapted to be received within a set of positioning recesses 128 to align a port of a valve with a passageway 126 when the valve is mounted on the support wall member. When valve 122 is mounted on support wall member 121 as shown in FIGS. 13 and 14, it is provided with an annular sealing element 130 disposed therebetween to further provide a closed zone defined by a portion of the upper surface of the support wall member, the underside of the valve and sealing element 130, communicating with passageway 126 and the port of the valve. Fixture 123 similarly is provided with a pair of depending pins 131 which are adapted to be received within a set of positioning recesses in the support wall member to locate the fixture in a position overlying a selected passageway 126. The fixture further is provided with an annular sealing element 132 which cooperates with a portion of the upper surface of the support wall member and the under side of the fixture to provide a closed zone communicating with the plenum through the associated passageway 132. Fixture 123 further is provided with a passageway 133 ported on the upper surface thereof. It further is provided with an annular seal 134 on the upper surface thereof which cooperates with the upper surface of the fixture and the underside of a workpiece 135 mounted on the sealing element to provide a closed zone communicating with passageway 133. A flexible conduit 136 interconnects a port of valve 122 and a port of passageway 133 in fixture 123.

When not in use, support wall member 121 is normally seated within the recess of the base member and passageways 126 are closed by a number of plugs 127. When it is desired to mount workpieces on the worktable of the machine to perform a machining or other function, a plug 127 disposed in the vicinity in which a workpiece is to be positioned is removed, a workpiece support fixture is mounted at such location as shown in FIGS. 13 and 14, and the workpiece to be machined is positioned on the fixture. A second plug 127 located near the positioned fixture is then removed and a valve 122 is mounted on the support wall member in the position as shown in FIGS. 13 and 14. Conduit 136 may either permanently interconnect a valve and a fixture or may be permanently connected to a valve and connected to the fixture as shown in FIGS. 13 and 14. With the fixture, workpiece and valve thus positioned on the support wall member, and the valve in the closed position, the vacuum pump is operated to apply a vacuum to plenum 124 and correspondingly to the closed zones between the fixture and the support wall member and also the valve and the support member to firmly hold such components to the support wall member. Valve 122 then is opened as shown in FIG. 14 to apply a vacuum to the closed zone between the workpiece and the fixture to firmly hold the workpiece to the fixture.

The embodiment of FIGS. 12 through 14 as described may be modified in a number of ways to provide greater flexibility, versatility and productivity. Different configurations of fixtures may be used with different configurations of workpieces. Workpieces may be positioned either on a fixture 123 or directly on the support wall member. A plurality of assemblies each including a valve 122, a fixture 123 and a flexible interconnecting conduit 136 may be used to mount similar or diverse workpieces. The arrangement further provides for positioning one or more workpieces at any location on the worktable of the machine. Similar and/or diverse workpieces may be nested on the worktable supported either on a fixture 123 or directly on the support wall member.

It further is within the contemplation of the present invention that each of the support wall members described along with a conventional porous spoilboard may interchangeability be mounted on a single base member. A porous spoilboard would be configured, in terms of its overall configuration, similar to any of the support wall members described, would be adapted to be received within and seated in the recessed portion of the base member to provide a plenum connectable to a vacuum pump and would be formed of a particleboard material or the like in the conventional manner to permit air to be drawn therethrough by the vacuum applied to the plenum.

In each of the embodiments described, one or more closed zones may be created anywhere on the worktable between one or more workpieces and one or more fixtures or the support wall member, to which a vacuum may be applied to firmly hold the one or more workpieces in a selected position or positions for machining or other processing. Different parts of different configurations may be nested on the worktable in a variety of arrangements. In addition, the support wall members of the several embodiments may be interchanged to provide even greater flexibility. With the selection of the most suitable support wall member and the positioning of the workpieces on the selected support wall member, productivity in the machining or other processing of workpieces may be greatly enhanced.

From the foregoing detailed description, it will be evident that there are a number of changes, adaptations and modifications of the present invention which come within the province of those persons having ordinary skill in the art to which the aforementioned invention pertains. However, it is intended that all such variations not departing from the spirit of the invention be considered as within the scope thereof as limited solely by the appended claims.

I claim:

1. A system for holding a workpiece on a worktable of a machine tool, comprising:

means including a wall member for supporting said workpiece, defining a plenum connectable to a vacuum producing means;

means cooperable with a surface of said workpiece and a seal, defining a zone;

means defining a passageway intercommunicating said plenum and said zone; and a valve disposed in said passageway.

2. A system according to claim 1 wherein said wall member includes a plurality of spaced openings, pairs of which may be selected to comprise sections of said passageway.

3. A system according to claim 1 wherein said wall member includes an opening communicating with said plenum, and said valve includes a conduit providing a port thereof, insertable in said opening, and a displaceable stem operable to open and close said valve.

4. A system according to claim 1 including a flexible conduit connected to said valve providing a portion of said passageway.

5. A system according to claim 1 wherein said passageway includes a portion through said wall member.

6. A system according to claim 1 including:

a fixture having a surface cooperable with said workpiece surface and said seal defining said zone, and an opening therethrough comprising a portion of said passageway and communicating with said zone;

a second seal disposed between a surface of said fixture and said wall member defining a second zone; and said wall member having a second passageway intercommunicating said plenum and said second zone.

7. A system according to claim 6 wherein said wall includes a second opening communicating with said plenum, and said valve includes a conduit providing a port thereof, insertable in said second opening, and a displaceable stem operable to open and close said valve.

8. A system according to claim 7 including a flexible conduit interconnecting said valve and said fixture providing a portion of said passageway.

9. A system according to claim 6 wherein said wall member includes a plurality of spaced openings, pairs of which may be selected to comprise sections of said passageway.

10. A system according to claim 1 wherein said plenum includes a partition wall cooperating with interior surfaces of said workpiece support means, defining a first plenum section isolated from a second plenum section, connectable to said vacuum producing means;

said wall member includes a surface cooperable with said workpiece surface and said seal to define said zone; and said supporting wall member includes a first opening therethrough comprising a portion of said passageway and communicating with said first plenum section, and a second opening therethrough comprising a portion of said passageway and intercommunicating said first plenum section and said zone.

11. A system according to claim 10 wherein said wall member includes a plurality of spaced openings, pairs of which may be selected to comprise sections of said passageways.

12. A system according to claim 10 wherein said wall member includes a third opening communicating with said second plenum section connectable to said vacuum producing means, and said valve includes a conduit providing a port thereof, insertable into said third opening, and a displaceable stem operable to open and close said valve.

13. A system according to claim 10 including a flexible conduit interconnecting said valve and said first opening.

14. A system according to claim 1 including a fixture mountable on said wall member, having a surface cooperable with said workpiece surface and said seal to define said zone, and an opening therethrough comprising a portion of said passageway communicating with said zone.

15. A system according to claim 14 wherein said wall member includes an opening communicating with said plenum, and said valve includes a conduit providing a port thereof insertable in said opening, and a displaceable stem operable to open and close said valve.

16. A system according to claim 15 including a conduit interconnecting said valve and said fixture providing a portion of said passageway.

17. A system according to claim 1 wherein said wall member includes a surface cooperable with said workpiece surface and said seal to define said zone, and an opening therethrough comprising a portion of said passageway, communicating with said zone.

18. A system according to claim 17 wherein said wall member includes a second opening therethrough communicating with said plenum, and said valve includes a port communicable with said second opening, and a displaceable stem operable to open and close said valve.

19. A system according to claim 17 including a conduit intercommunicating said valve with said opening in said wall member, providing another portion of said passageway.

20. A system according to claim 1 including a base member provided with a recess, and wherein said wall member is removably mounted on said base member to close said recess thereby forming said plenum.

21. A system according to claim 1 including an endless seal disposed between a portion of said valve including a port thereof and said. wall member cooperating therewith to provide a second zone, and wherein said wall member includes an opening intercommunicating said plenum and said second zone, comprising a portion of said passageway.

22. A system according to claim 1 including a porous spoilboard which may be substituted for said wall member.

* * * * *